US011852127B2

(12) United States Patent
Barnhouse, Jr. et al.

(10) Patent No.: US 11,852,127 B2
(45) Date of Patent: Dec. 26, 2023

(54) RETAINER ASSEMBLY FOR PUMP AND METHODS

(71) Applicant: SPM Oil & Gas Inc., Fort Worth, TX (US)

(72) Inventors: James A. Barnhouse, Jr., Spring, TX (US); Daryl J. Belshan, Weatherford, TX (US); Jacob Brown, Waller, TX (US); Henry Do, Spring, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 0 days.

(21) Appl. No.: 17/586,266

(22) Filed: Jan. 27, 2022

(65) Prior Publication Data

US 2023/0235730 A1 Jul. 27, 2023

(51) Int. Cl.

| | |
|---|---|
| ***F04B 53/22*** | (2006.01) |
| ***F04B 39/12*** | (2006.01) |
| ***F04B 19/00*** | (2006.01) |
| ***F04B 53/10*** | (2006.01) |

(52) U.S. Cl.

CPC ..... *F04B 39/12* (2013.01); *F04B 19/00* (2013.01); *F04B 53/10* (2013.01); *F04B 53/22* (2013.01)

(58) Field of Classification Search

CPC ..... F04B 53/22; F04B 39/14; F16B 2/04–06; F16B 2/10–18; F16J 13/22; F16J 13/06–10

See application file for complete search history.

(56) References Cited

U.S. PATENT DOCUMENTS

| | | | | | |
|---|---|---|---|---|---|
| 1,144,152 | A * | 6/1915 | Miller | E05B 83/24 | 292/6 |
| 1,458,391 | A * | 6/1923 | Burton | F16J 13/08 | 292/6 |
| 2,203,364 | A * | 6/1940 | Rathbun | F16J 13/10 | 220/240 |
| 2,296,710 | A * | 9/1942 | Fischer | F28F 9/00 | 165/158 |
| 2,436,016 | A * | 2/1948 | Myers | F16J 13/08 | 220/248 |
| 2,792,963 | A * | 5/1957 | Smith | F16J 13/08 | 220/248 |

(Continued)

OTHER PUBLICATIONS

Written Opinion and International Search Report for Int'l. Patent Appln. No. PCT/US2023/060702, dated May 15, 2023 (11 pgs).

*Primary Examiner* — Thomas Fink

(57) ABSTRACT

A retainer assembly and plug for a fluid end of a pump system includes a retainer body. A plurality of tongues are movably arranged about the retainer body. The tongues are moveable between a pre-installed configuration and an installed configuration depending on the position of the retainer body relative to the tongues. In the installed configuration engaging flanges of the tongues are positioned in a retaining channel formed in a bore of the fluid end and retain the retainer assembly to the fluid end. A plug is configured to sealingly fit to the bore of the fluid end inboard of the retainer assembly and a locking mechanism is configured to secure the retainer assembly to the plug, and when so secured, the position of the retainer body is maintained relative to the plurality of tongues and the retainer assembly is maintained in the installed configuration.

20 Claims, 13 Drawing Sheets

(56) References Cited

U.S. PATENT DOCUMENTS

| | | | | | |
|---|---|---|---|---|---|
| 3,002,774 | A * | 10/1961 | Chapellier | F16J 13/08 | 24/607 |
| 3,261,627 | A * | 7/1966 | Jonsson | B01J 3/03 | 292/6 |
| 3,263,629 | A * | 8/1966 | Higuchi | B60P 7/0807 | 410/105 |
| 3,277,837 | A | 10/1966 | Pangburn | | |
| 3,449,860 | A * | 6/1969 | Fontenot | F16J 13/08 | 292/37 |
| 3,539,215 | A * | 11/1970 | Lauterbach | F16J 13/08 | 220/315 |
| 5,148,938 | A * | 9/1992 | Morgan, Jr. | F16J 13/08 | 220/360 |
| 6,260,971 | B1 * | 7/2001 | Cardellini | F16M 13/00 | 396/419 |
| 6,382,940 | B1 | 5/2002 | Blume | | |
| 6,623,259 | B1 | 9/2003 | Blume | | |
| 7,341,435 | B2 | 3/2008 | Vicars | | |
| 8,550,102 | B2 | 10/2013 | Small | | |
| 8,998,593 | B2 | 4/2015 | Vicars | | |
| 9,382,905 | B2 | 7/2016 | Huang | | |
| 10,082,137 | B2 | 9/2018 | Graham et al. | | |
| 2005/0201881 | A1 | 9/2005 | Jensen et al. | | |
| 2019/0264683 | A1 * | 8/2019 | Smith | F04B 53/007 | |
| 2020/0080660 | A1 * | 3/2020 | Dyer | F04B 53/16 | |
| 2020/0080661 | A1 * | 3/2020 | Mullins | F16K 27/12 | |

* cited by examiner

RETAINER ASSEMBLY FOR PUMP AND METHODS

TECHNICAL FIELD

The present disclosure relates to pump assemblies and, in particular, retainer assemblies for such pump assemblies and methods of assembly.

BACKGROUND

In hydraulic fracturing, and other similar applications, the pumping equipment used to pump fluid media into a well is an important part of the fracturing system and process. Reciprocating pump systems have been used for decades to propel a fluid media, typically a mixture of water, sand and chemicals, for example, into a well at high pressures and flow rates. Increasing demands of pressure pumping has required such pumps to evolve by increases in size, horsepower rating, and pressure capabilities. As a result, designing pump assemblies to be reliable and easily maintained has become an increasingly important consideration.

Reciprocating pump systems typically include fluid end blocks with fluid inlet and outlet passages for the fluid media. Each of the fluid inlets and fluid outlets include a check valve to control the flow of fluid through the fluid end block. Such pump systems have a plunger that generates the substantial pumping flows at pressures required to pump the fluid media through the pump. Pump systems typically have both a cover assembly and a retainer for access to the inner workings of the fluid end of the pump for initial assembly and maintenance.

Current hydraulic fracturing fluid ends typically require a threaded retainer to retain a suction cap in position in the fluid end block. To tighten the retainer, the use of a hammer wrench and a sledgehammer are typically required to generate a preload in the threads. The use of the hammer can give an imprecise result and is a swinging mass that exposes the user to harm. Due the nature of the pumping process and high forces generated in the fluid end block, the retainer can work loose. This creates the potential of the retainer being forcefully ejected from the fluid end block and/or may cause damage to the block itself.

U.S. Pat. No. 8,402,880 discloses a pump system with a fluid block. A retaining system secures a closure at an installed position within a bore of the fluid block. The bore has screw threads along at least a portion thereof. The closure has an internally threaded hold extending therein. The closure in the installed position closes the bore. The retaining system includes a retaining cover or nut for holding the closure in the bore. The retaining nut has external threads that are engageable with the screw threads of the bore such that the cover is rotatable relative to the housing in a tightening direction for movement of the cover into the bore toward the closure and rotatable in an opposite, loosening direction for movement of the cover out from the bore away from the closure.

There is a need for an easily assembled, installed, removed, and reliable retainer for a fluid end of a pump system. Devices and methods according to the disclosure satisfy the need.

The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

SUMMARY

In one aspect, the disclosure set out a retainer assembly and plug for a fluid end of a pump system including a retainer body. A plurality of tongues are movably arranged about and in contact with the retainer body. Each of the tongues are moveable between a pre-installed configuration and an installed configuration depending on the position of the retainer body relative to the plurality of tongues. Each of the tongues include an engaging flange configured to engage a retaining channel formed in the fluid end, wherein the movable tongues are movable between the pre-installed configuration defining a first diameter configured to permit the retainer assembly to be inserted into a bore of the fluid end and an installed configuration defining a second diameter, the second diameter being larger than the first diameter. When in the installed configuration the engaging flanges are positioned in the retaining channel and retain the retainer assembly to the fluid end. A plug is shaped and sized to sealingly fit to the bore of the fluid end inboard of the retainer assembly and a locking mechanism is configured to secure the retainer assembly to the plug, and when so secured, the position of the retainer body is maintained relative to the plurality of tongues and the retainer assembly is maintained in the installed configuration.

In another aspect, the disclosure includes a fluid end for a reciprocating pump system, including a fluid end block defining a fluid chamber. A plunger is reciprocally disposed in the fluid chamber to generate fluid pressure therewithin. An outlet fluid passage is formed in the fluid end block in fluid communication with the fluid chamber, the outlet fluid passage including an outlet valve. An inlet fluid passage is formed in the fluid end block in fluid communication with the fluid chamber, the inlet fluid passage including an inlet valve and a retainer assembly includes a retainer body. A plurality of tongues are movably arranged about and in contact with the retainer body. Each of the tongues are moveable between a pre-installed configuration and an installed configuration depending on the position of the retainer body relative to the plurality of tongues. Each of the tongues include an engaging flange configured to engage a retaining channel formed in the fluid end, wherein the movable tongues are movable between the pre-installed configuration defining a first diameter configured to permit the retainer assembly to be inserted into a bore of the fluid end and an installed configuration defining a second diameter, the second diameter being larger than the first diameter. When in the installed configuration the engaging flanges are positioned in the retaining channel and retain the retainer assembly to the fluid end. A plug is shaped and sized to sealingly fit to the bore of the fluid end inboard of the retainer assembly and a locking mechanism is configured to secure the retainer assembly to the plug, and when so secured, the position of the retainer body is maintained relative to the plurality of tongues and the retainer assembly is maintained in the installed configuration.

In yet another aspect, the disclosure includes a method of installing a retainer assembly into a fluid end block for a reciprocating pump system. The method includes positioning a plug into the fluid end block; installing the retainer assembly into the fluid end block after the plug is positioned with the retainer assembly in a pre-installed configuration;

moving a plurality of tongues of the retainer assembly radially outwardly; engaging with the plurality of tongues a retaining groove formed in the fluid end block; and engaging the plug with the retainer assembly to lock the tongues in an installed configuration in the fluid end block.

DETAILED DESCRIPTION

Figure 1:
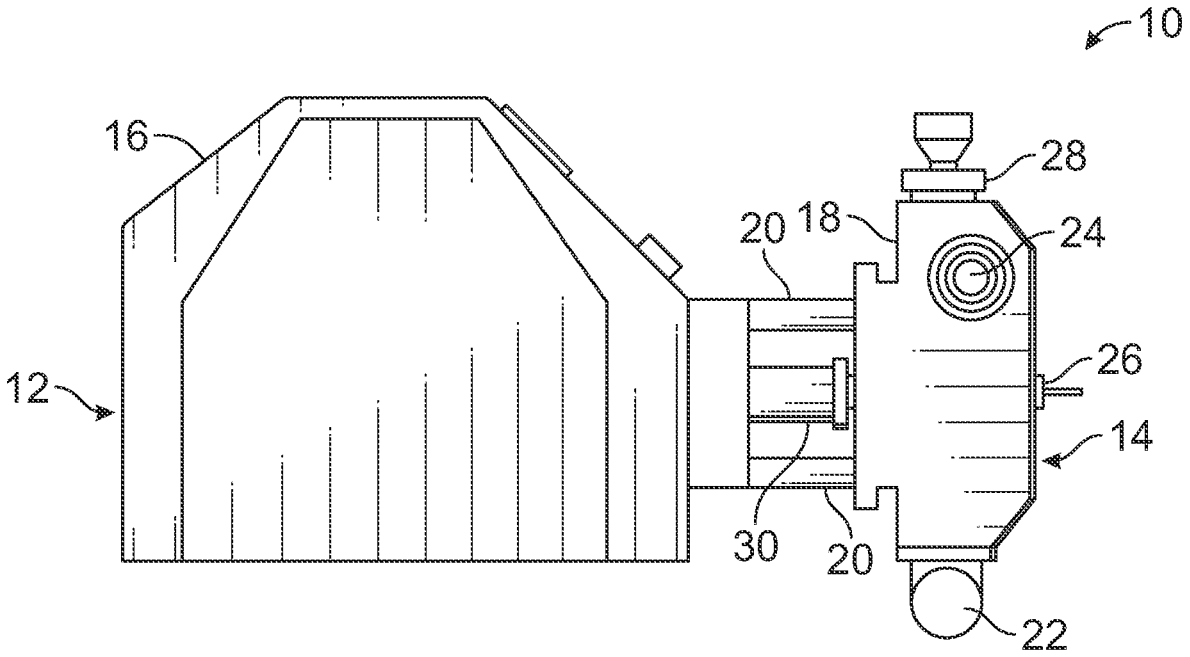
FIG. 1 is an elevation view of a reciprocating pump system according to an exemplary embodiment, the reciprocating pump system including a fluid end.

Now referring to the drawings, wherein like elements refer to like reference numbers, there is illustrated in FIG. 1 an exemplary embodiment of a reciprocating pump system (generally referred to by the reference numeral 10) including a power end portion 12 and a fluid end portion 14 operably coupled thereto. The power end portion 12 includes a housing 16 in which a crankshaft (not shown) is disposed, as is known, the crankshaft being operably coupled to an engine or motor (not shown), as is known, which is configured to drive the crankshaft. The fluid end portion 14 includes a fluid end block 18, which is connected to the housing 16 via a plurality of stay rods 20. The fluid end block 18 includes a fluid inlet passage 22 and a fluid outlet passage 24, which are spaced in a parallel relation. A plurality of fluid end retainer assemblies 26, one of which is shown in FIG. 1, is connected to the fluid end block 18 opposite the stay rods 20. A plurality of cover assemblies 28, one of which is shown in FIG. 1, is connected to the fluid end block 18 opposite the fluid inlet passage 22. A plunger rod assembly 30 extends out of the housing 16 and into the fluid end block 18. Other configurations of a reciprocating pump system 10 are contemplated.

Figure 2:
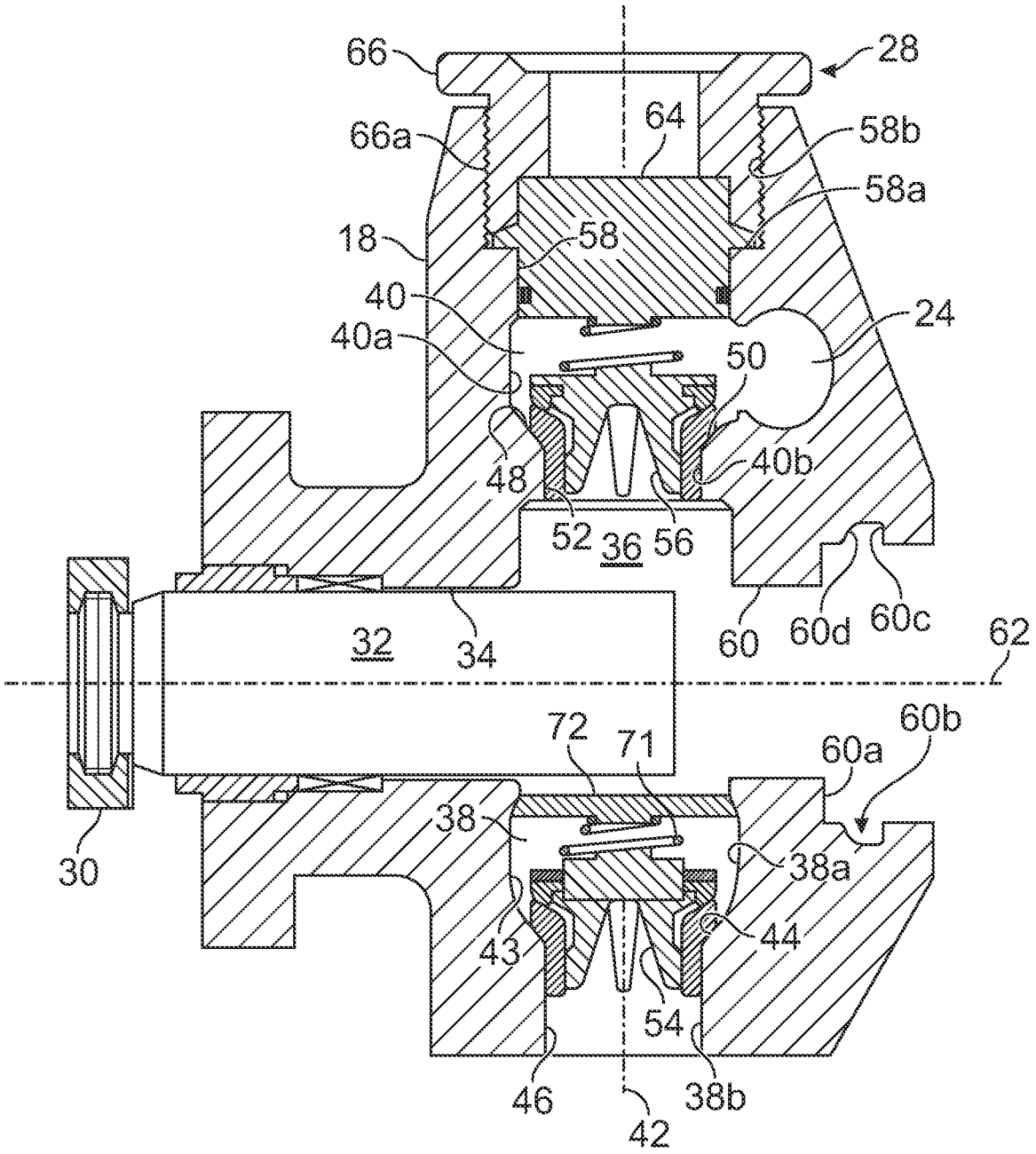
FIG. 2 is a section view of the fluid end of FIG. 1 according to an exemplary embodiment, the fluid end including a fluid end block or housing and inlet and outlet valves.

In embodiments, as illustrated in FIG. 2 with continuing reference to FIG. 1, the plunger rod assembly 30 includes a plunger 32, which extends through a bore 34 formed in the fluid end block 18, and into a fluid chamber 36 formed in the fluid end block 18. The plunger 32 is reciprocally disposed in the fluid chamber 36 to displace the fluid therewithin, thus creating flow. In embodiments, a plurality of parallel-spaced bores may be formed in the fluid end block 18, with one of the bores being the bore 34, a plurality of fluid chambers may be formed in the fluid end block 18, with one of the fluid chambers being the fluid chamber 36, and a plurality of parallel-spaced plungers may extend through respective ones of the bores and into respective ones of the fluid chambers, with one of the plungers being the plunger 32.

The fluid end block 18 includes inlet and outlet fluid passages 38 and 40 formed therein, which are generally coaxial along a fluid passage axis 42. Under conditions to be described below, fluid flows from the inlet fluid passage 38 toward the outlet fluid passage 40 along the fluid passage axis 42. The fluid inlet passage 22 is in fluid communication with the fluid chamber 36 via the inlet fluid passage 38. The fluid chamber 36 is in fluid communication with the fluid outlet passage 24 via the outlet fluid passage 40.

The inlet fluid passage 38 may include an enlarged-diameter portion 38*a* and a reduced-diameter portion 38*b* extending downward therefrom (oriented as in the figure), which direction may also be considered the upstream direction.

The enlarged diameter portion 38*a* defines a tapered internal shoulder 43 and thus a frusto-conical surface 44 of the fluid end block 18. The reduced-diameter portion 38*b* defines an inside surface 46 of the fluid end block 18. Similarly, the outlet fluid passage 40 includes an enlarged-diameter portion 40*a* and a reduced-diameter portion 40*b* extending downward therefrom. The enlarged-diameter portion 40*a* defines a tapered internal shoulder 48 and thus a frusto-conical surface 50 of the fluid end block 18. The reduced-diameter portion 40*b* defines an inside surface 52 of the fluid end block 18. The frusto-conical surfaces 44, 50 form valve seats for respective inlet and outlet valves 54, 56.

An inlet valve 54 is disposed in the inlet fluid passage 38 adjacent the frusto-conical surface 44 and the inside surface 46. Similarly, an outlet valve 56 is disposed in the outlet fluid passage 40 adjacent at least the frusto-conical surface 50 and the inside surface 52. In an exemplary embodiment, each of valves 54 and 56 is a spring-loaded valve that is actuated by a predetermined differential pressure thereacross.

A counterbore 58 is formed in the fluid end block 18, and is generally coaxial with the outlet fluid passage 40 along the fluid passage axis 42. In embodiments, the fluid end block 18 may include a plurality of parallel-spaced counterbores, one of which may be the counterbore 58, with the quantity of counterbores equaling the quantity of plunger throws included in the pump system 10. The cover assembly 28 shown in FIGS. 1 and 2 includes at least a plug 64 and a fastener 66. In embodiments, the cover assembly 28 may be disconnected from the fluid end block 18 to provide access to, for example, the counterbore 58, the fluid chamber 36, the plunger 32, the outlet fluid passage 40 or the outlet valve 56. In embodiments, the pump system 10 may include a plurality of plugs, one of which is the plug 64, and a plurality of fasteners, one of which is the fastener 66, with the respective quantities of plugs and fasteners equaling the quantity of plunger throws included in the pump system 10.

A counterbore 60 is formed in the fluid end block 18, and is generally coaxial with the bore 34 along an axis 62. The counterbore 60 defines an internal shoulder 60*a* and includes a retainer channel 60*b* in-cut into the counterbore and adjacent and outboard the internal shoulder 60*a*. In embodiments, the retainer channel 60*b* includes a channel shoulder 60*c*, which faces inwardly toward the internal shoulder 60 and is normal to the axis 62. Opposite the channel shoulder 60*c* is an arcuate face 60*d*.

In embodiments, the fluid end block 18 may include a plurality of parallel-spaced counterbores, one of which may be the counterbore 60, with the quantity of counterbores equaling the quantity of plunger throws included in the pump system 10. The counterbore 60 is sized and shaped to receive a retainer assembly 26 (see, e.g., FIGS. 3, 14 and 17) according to embodiments disclosed herein. The retainer assembly 26 may be disconnected from the fluid end block 18 to provide access to, for example, the counterbore 60, the fluid chamber 36, the plunger 32, the inlet fluid passage 38, or the inlet valve 54. The retainer assembly 26 may then be reconnected to the fluid end block. In several exemplary embodiments, the pump system 10 may include a plurality of plugs, one of which is the plug 68, shown in FIGS. 8-13 and 16, for example, with the respective quantities of plugs and retainer assemblies 26 equaling the quantity of plunger throws included in the pump system 10.

Focusing now on the inlet fluid passage 38, a biasing member 71 is positioned within the inlet fluid passage 38. The biasing member 71 may be a coil spring. In one embodiment the biasing member 71 is a conical coil spring. The biasing member 71 may be retained in place by a spring stop 72 as is known. When installed as shown in FIG. 2, the biasing member 71 exerts a selected biasing force on the inlet valve 54 that holds the inlet valve against a seat positioned on the frusto-conical surface 44 to create a closed or sealed condition. When a pressure differential on the inlet valve 54 exceeds the closing force generated by the biasing member 71, the inlet valve opens and permits fluid media to enter the fluid chamber 36.

Figure 3:
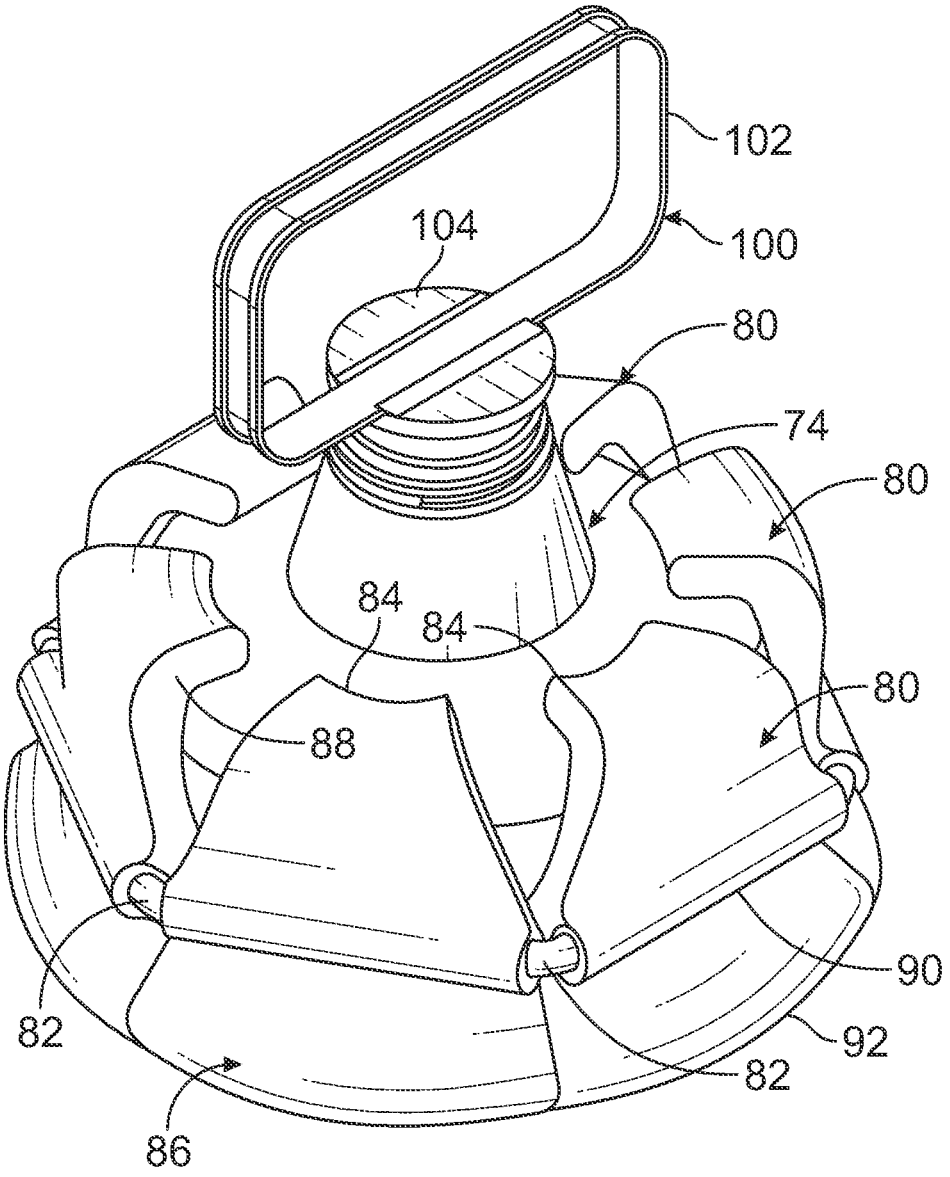
FIG. 3 is a perspective view of a retainer assembly in a pre-installed configuration according to the disclosure.
Figure 4:
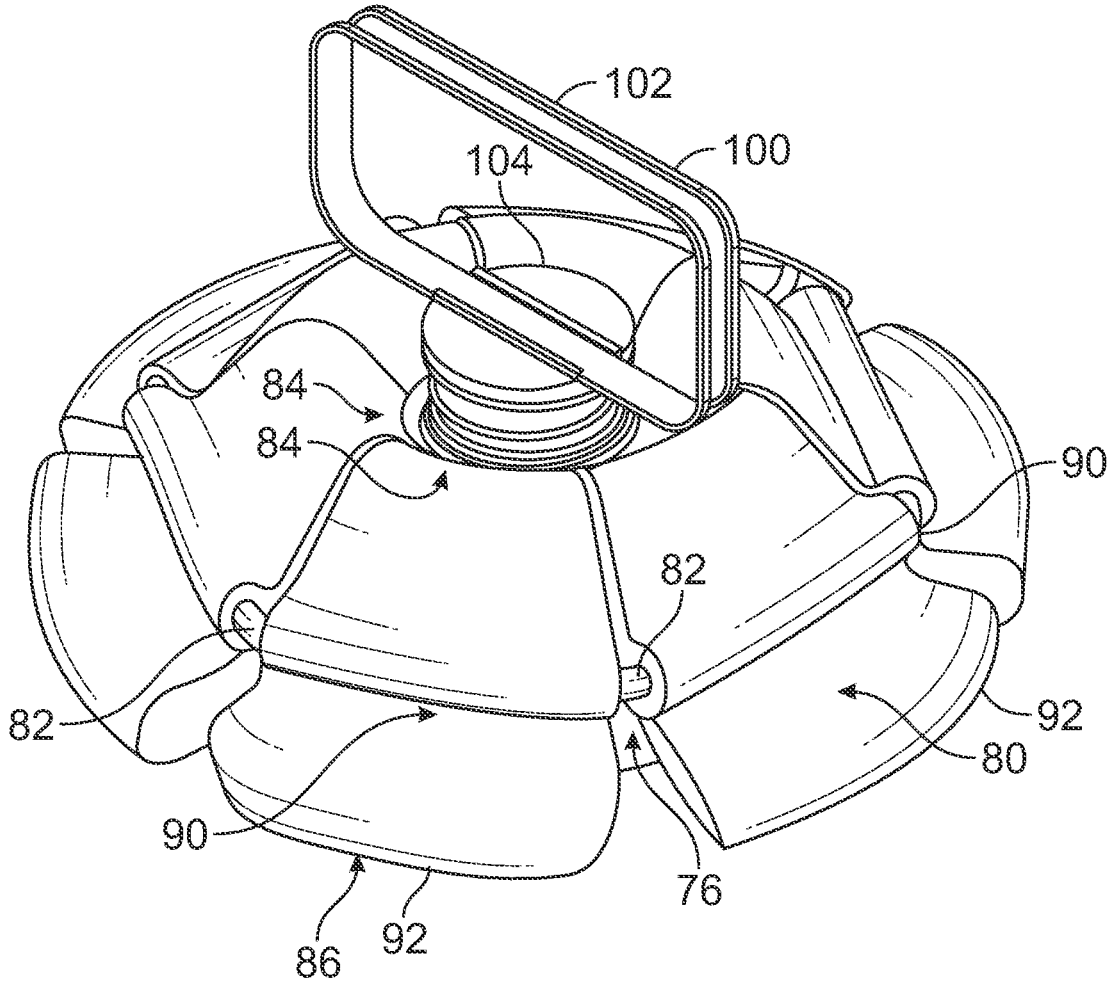
FIG. 4 is the retainer assembly of FIG. 3 in the installed configuration.
Figure 5:
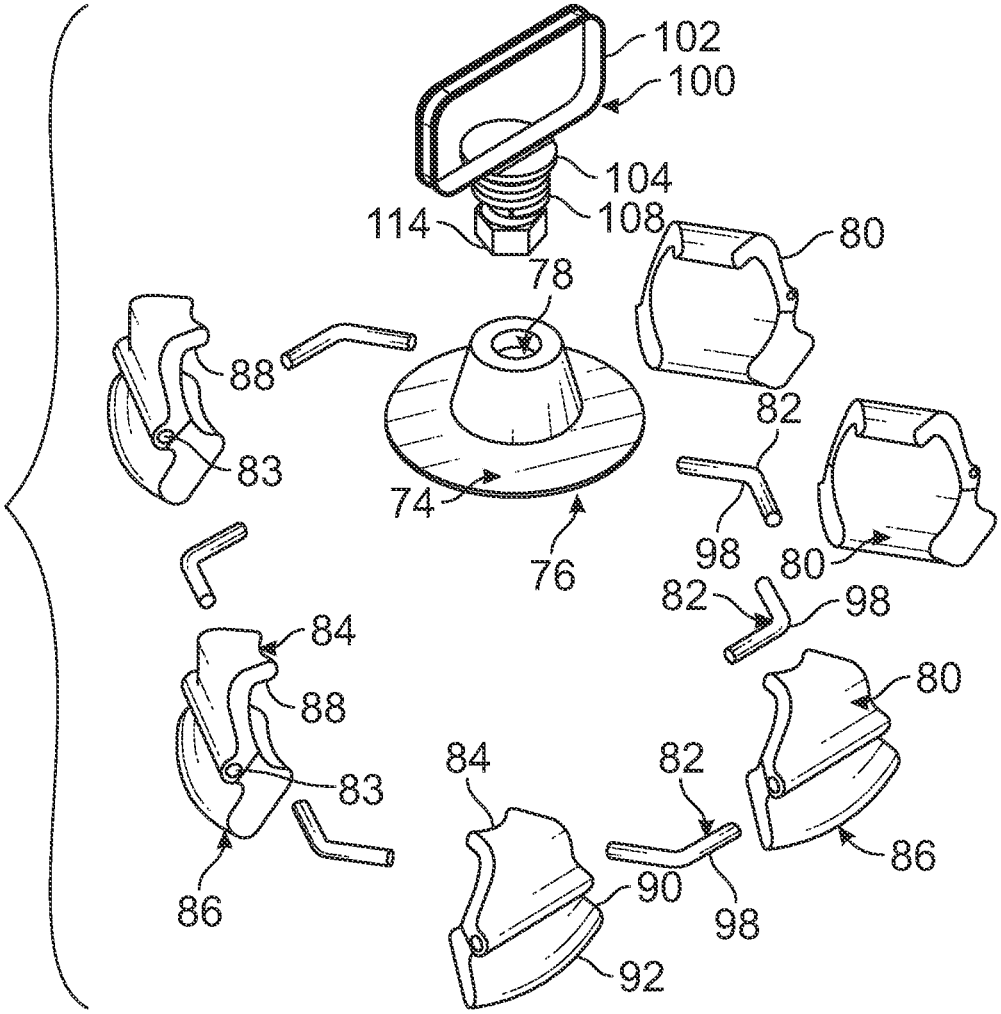
FIG. 5 is an exploded perspective view of the retainer assembly of FIGS. 3 and 4.

Turning to FIGS. 3-5, the retainer assembly 26 includes a retainer body 74. The retainer body 74 is generally a bell shape, i.e., a cone with a flaring rim 76, and at least in part produces the desired configurations of the retainer assembly as will be discussed herein. The retainer body 74 includes a central opening 78. Arranged about the retainer body 74 is a plurality of tongues 80, in this embodiment in the general form of movable levers, which are interconnected with pivot rods 82 such that the tongues 80 are held on the outside of the retainer body 74 and can rock on the pivot rods from a pre-installed configuration shown in FIG. 3, where the tongues define a first diameter measured radially from one side of the retainer assembly 26 to an opposite side of the retainer assembly, to an installed configuration shown in FIG. 4 and FIG. 12, where the tongues assume a second diameter measured radially, and wherein the second diameter is larger than the first diameter.

The tongues 80 each include a passage 83 sized and shaped to receive a pivot rod 82 at each respective end thereof. Each tongue 80 flares outwardly in a wedge shape such that a top edge 84 is narrower than the bottom edge 86. Each tongue 80, at the top edge 84 may have an inwardly curving hook feature 88 configured to contact the retainer body 74 when arranged thereabout and interconnected by the pivot rods 82. Each tongue 80, at the bottom edge 86 includes an inward curving portion 90 and flares outwardly to an engaging flange portion 92 with an upper edge 94 that is planar and a curved side 96 on an outer, lower corner thereof. The upper edge 94 is positioned to engage the channel shoulder 60*c* when the retainer assembly is installed and the curved side 96 is configured to be positioned adjacent the arcuate face 60*d* when the bottom edge 86 is positioned within the retainer channel 60*b* as will be described in more detail below (see, e.g., FIG. 12).

Each pivot rod 82 has a bend 98 such that when a pivot rod is inserted in two adjacent ones of the tongues 80 an angle is formed between the adjacent tongues. A plurality of tongues 80 interconnected by pivot rods 82 therefore are held in a round arrangement about the retainer body 74.

Figure 6:
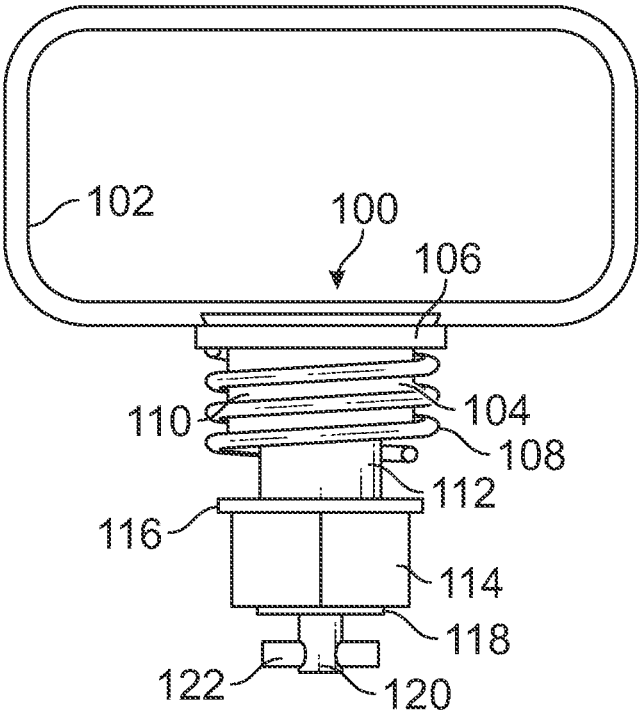
FIG. 6 is a side view of a locking mechanism of the retainer assembly of FIGS. 3-5.
Figure 7:
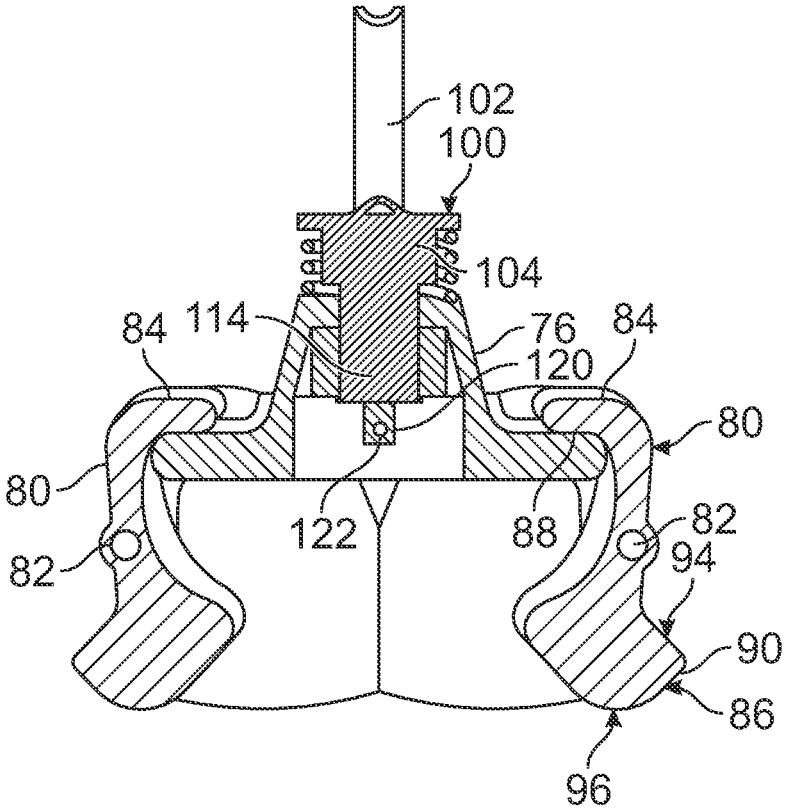
FIGS. 7-12 are cross section side views of the retainer assembly of FIGS. 4-6 in an installation and locking sequence.

The retainer assemblies 26 include a locking mechanism 100, referring in particular to FIG. 6. The locking mechanism 100 includes a handle 102 that is shaped and sized to be grasped by an operator. The handle 102 is fixedly connected to a locking body 104 which has a spring seat 106 adjacent the handle 102. The spring seat 106 may be a flange formed on the locking body 104. A coil spring 108 is positioned on the seat. The locking body 104 includes a first portion 110 sized and shaped to support the coil spring 108 thereon, a mid-portion 112 that may be narrower in diameter than the first portion, and a distal portion 114, which is spaced apart from the first portion by the mid-portion and may be the same general diameter as that of the first portion. The mid-portion 112 may be sized and shaped to fit to the opening 78 of the retainer body 74 without lateral movement, while permitting rotation of the locking body 104 and movement of the mid-portion in and out of the retainer body.

In embodiments, the distal potion 114 is threadably connectable and dis-connectable to the mid-portion 112. A flange 116 may be formed at the upper end of the distal portion 114. The flange 116 may be a washer or the like. A surface 118 is formed by the mid-portion 112 extending from the distal portion 114 opposite the flange 116. A post 120 extends axially from surface 118 and a locking pin 122 is attached to the post and positioned to extend laterally at least one direction away from the post and in embodiments both directions.

The locking mechanism 100 is attached to the retainer body 74 by inserting the mid-portion 112 into the opening 78 of the retainer body 74 with the distal portion 114 removed. The distal portion 114 is threaded onto the mid-portion 112 whereupon the handle 102 and first portion 110 are positioned outside the retainer body 74 with the spring 108 biasing the handle and first portion outwardly such that the flange 116 of the distal portion 114 is biased inside and against the retainer body 74.

As shown in FIGS. 8-13, the fluid end 18 (see also FIG. 2) includes a plug 68. The plug 68 is sized and shaped to be disposed in the counterbore 60, engaging the internal shoulder 60*a* and sealingly engaging an inside cylindrical surface defined by the reduced-diameter portion of the counterbore 60. In an exemplary embodiment, the plug 68 may be characterized or referred to as a suction cap. The plug 68 includes a locking post 69, which may be threaded into the plug 68.

In a most general form, the plug 68 is inserted into the counterbore 60 and the retainer assembly 26 is inserted into the bore thereafter. The action of inserting the retainer assembly 26 causes the tongues 80 to pivot from the pre-installed configuration shown in FIG. 3 to the installed configuration shown in FIG. 4 whereupon the tongues are caused to rotate radially outwardly and into the retainer channel 60*b*. The retainer assembly 26 is secured to the plug 68 which prevents the tongues 80 from withdrawing from the retainer channel 60*b* thereby locking both the retainer assembly and plug in position to the fluid end 18. The tongues 80 are held in contact against the plug 68 and while locked into the retainer channel 60*b*, hold the plug in sealing contact with the counterbore 60 of the fluid end 18.

Figure 8:
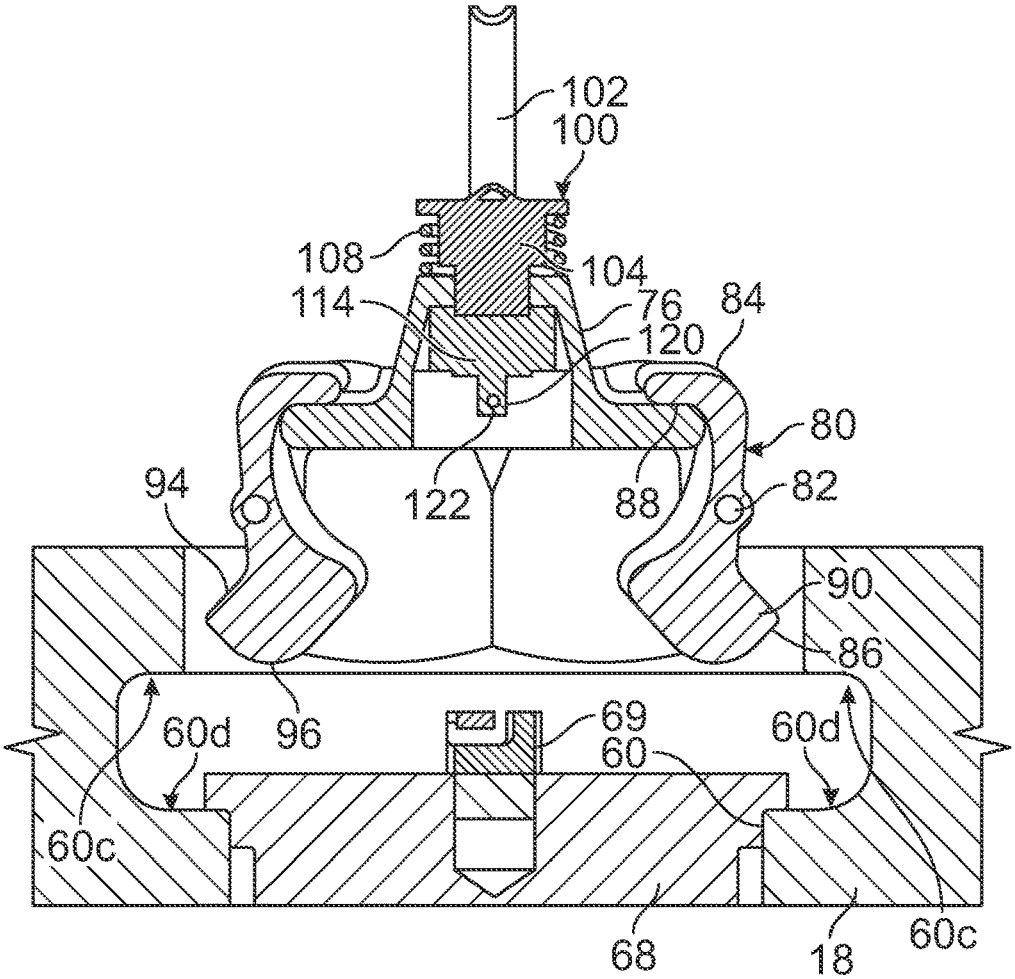
Figure 9:
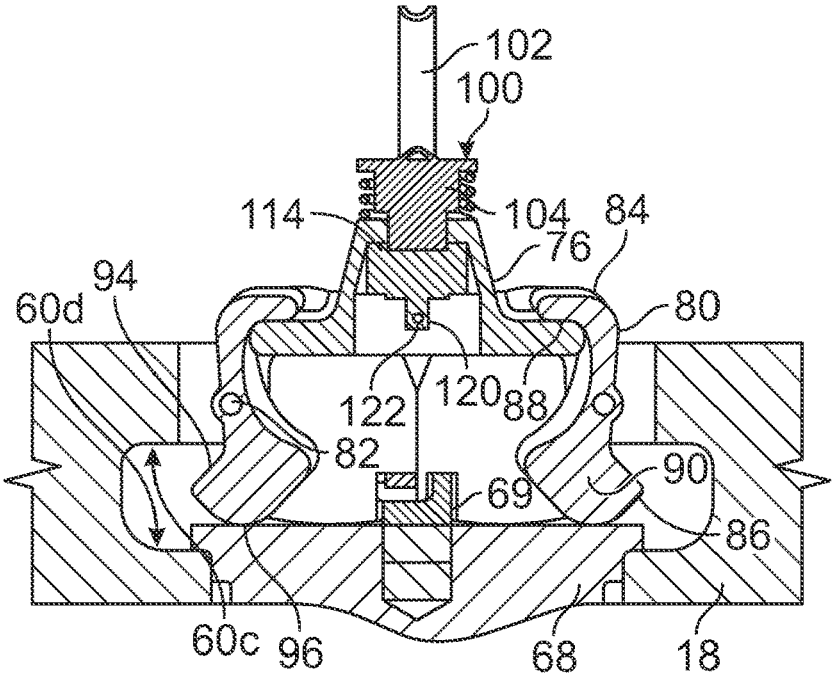
Figure 10:
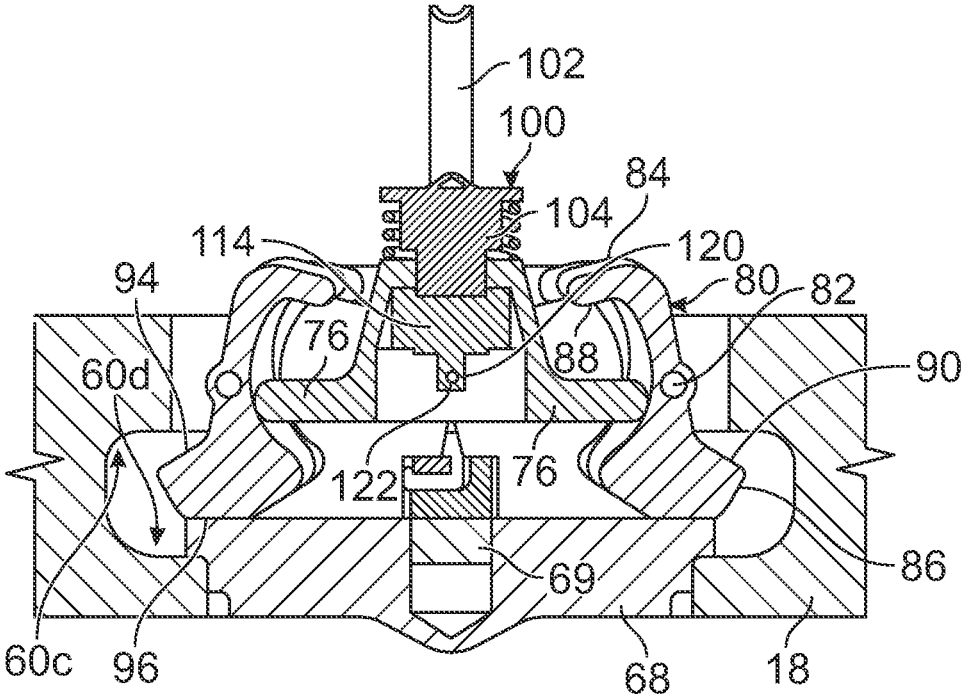
Figure 11:
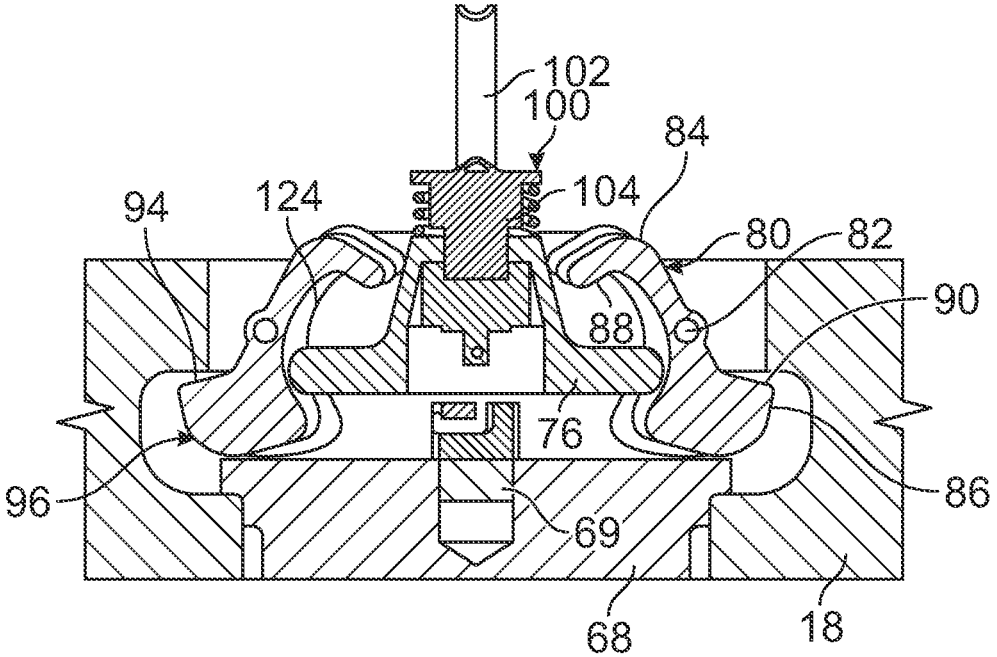

In particular, starting with FIG. 8, the plug 68 is positioned within the fluid end 18 counterbore 60. As shown, each of the tongues 80 are hanging from the rim 76 of the retainer body 74 by way of the hook 88 part. With an operator holding the handle 102 of the retainer assembly 26, the bottom edges 86 of the tongues 80 are inserted first into the counterbore 60. In FIG. 9 the curved sides 96 of the tongues 80 are brought into contact with the plug 68. At the same time the bottom edge 86 of the tongues 80 assume a position radially in the same plane as the retainer channel 60*b*. As shown in FIG. 10, because of the curvature of the curved sides 96 as the tongues 80 are advanced the bottom edge 86 of the tongues tend to pivot outwardly on rods 82 and begin moving radially into the retainer channel 60*b*. In FIG. 11, as the operator continues to advance the retainer assembly 26 into the counterbore 60 of the fluid end 18, the rim 76 of the retainer body 74 (see FIG. 5) slides toward the bottom edge 86 of the tongues 80 along an arcuate inner surface 124 of the tongues. The tongues 80 are urged, because they cannot advance further into the counterbore 60, by the advancement of the rim 76 along the inner surface 124 and responsively pivot radially outwardly into the configuration shown in FIG. 4. At the same time, the cone shape of the retainer body 74 permits the top edge 84 of each tongue 80 to pivot radially inwardly as the retainer body 74 approaches the plug 68 and the bottom edges 86 rotate radially outwardly.

Figure 12:
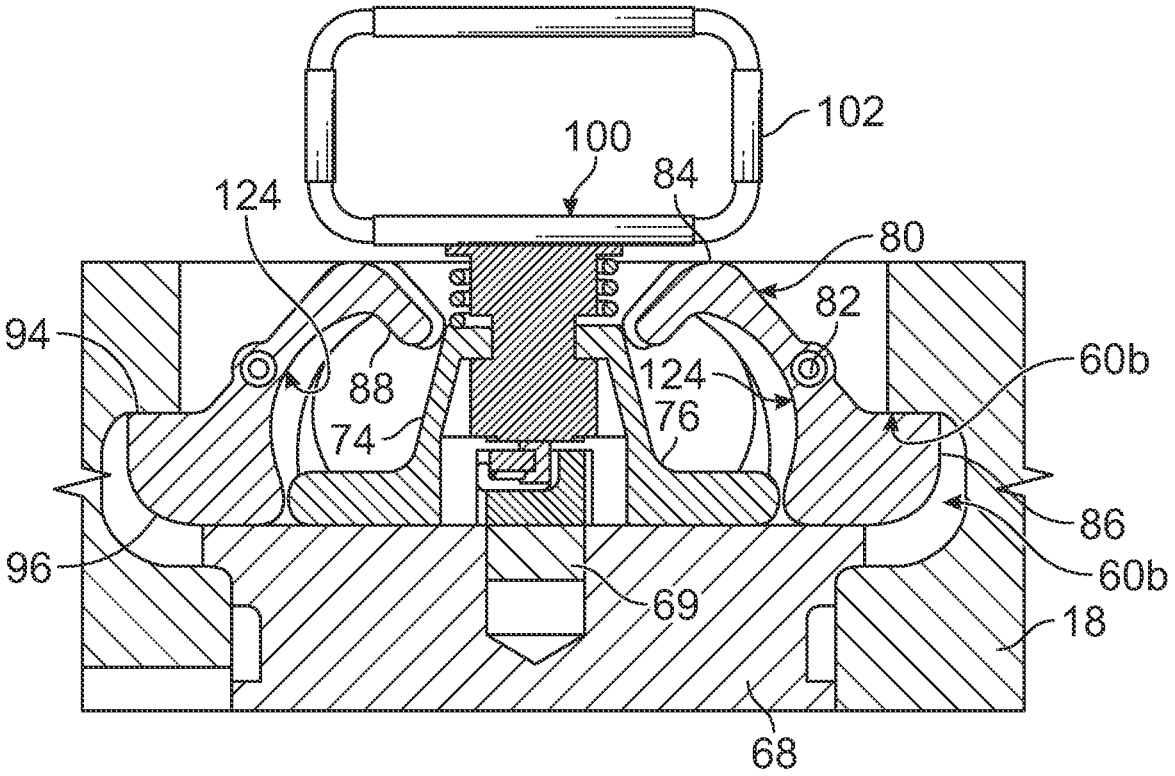

FIG. 12 shows the final installed and locked position of the tongues 80 and rim 76 of the retainer body 74. Specifically the rim 76 is in contact with the bottom edge 86 of the tongues 80 with the upper edge 94 in face-to-face contact with channel shoulder 60*c*. Both the bottom edge 86 and the retainer body 74 are in contact with the plug 68. The retainer assembly 26 is rotated, by turning the handle 102, for example 90 degrees, thereby locking the pin 122 to the post 69.

Figure 13:
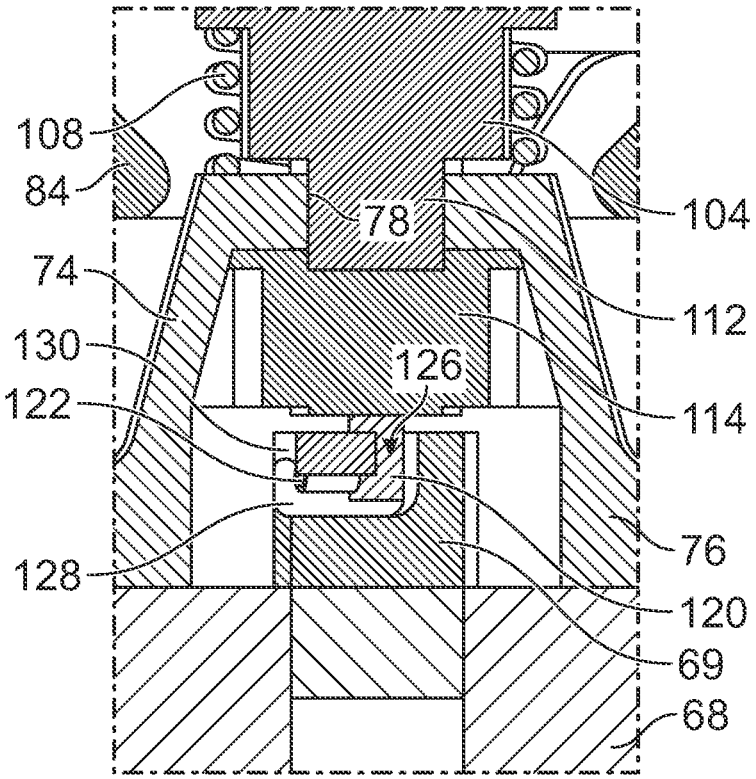
FIG. 13 is a close up cross section side view of the locking mechanism engaging to a plug.

FIG. 13 shows an embodiment of how the pin 122 locks the retainer assembly 26 to the post 69 of the plug 68. Also referring to FIG. 12, the post 69 includes a lateral slot 126 which is sized and shaped to receive therein the pin 122. The slot 126 opens to a passageway 128 which may extend in an arc of about 90 degrees. At the end of the passageway 128 is a notch 130 cut in the direction toward the handle that deviates from the passageway. With the retainer assembly 26 in the position shown in FIG. 12, the operator urges the handle 102 (see FIG. 12) toward the plug 68 which urges the body 104, post 120, and pin 122 toward the post 69. With the pin 122 aligned with the slot 126, the pin may be lowered into the slot and passageway 128, which compresses the spring 108. The operator rotates the handle 102 which rotates the body 104 and post 120. Rotation of the post 120 rotates the pin 122 in the passageway 128 until the pin is stopped at the notch 130. Releasing the handle 102 permits the spring 108 to pull the body 104 outwardly relative to the fluid end 18 (see FIG. 12). The pin 122 comes to rest locked in the notch 130 biased by the spring 108, which inhibits rotation of the body 104.

With the retainer assembly 26 locked to the post 69 of the plug 68 the rim 86 of the retainer body 74 is held against the arcuate surface 124 which maintains the bottom edge 86 of the tongues 80 in the retainer channel 60*b* in the installed configuration. When uninstalling the retainer assembly 26 the shape of the retainer body 74 engages the top 84 of the tongues 80 which applies leverage to the tongues and helps to disengage the bottom edge 86 from the retainer channel 60*b*.

Figure 14:
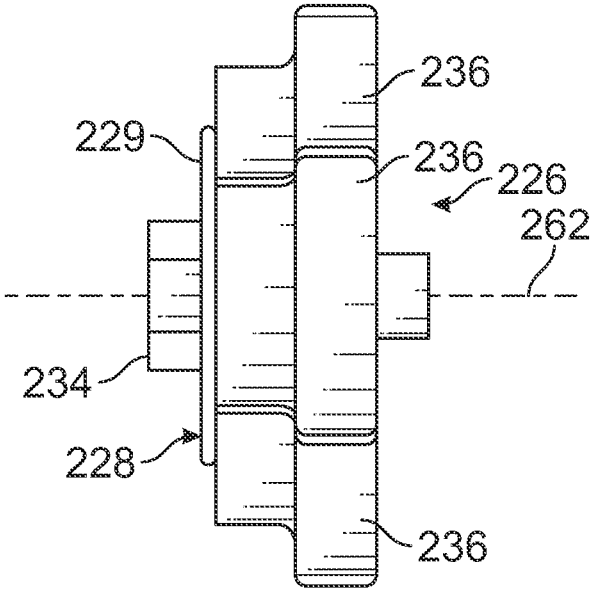
FIG. 14 is a side view of a retainer assembly according to an alternative embodiment.
Figure 15:
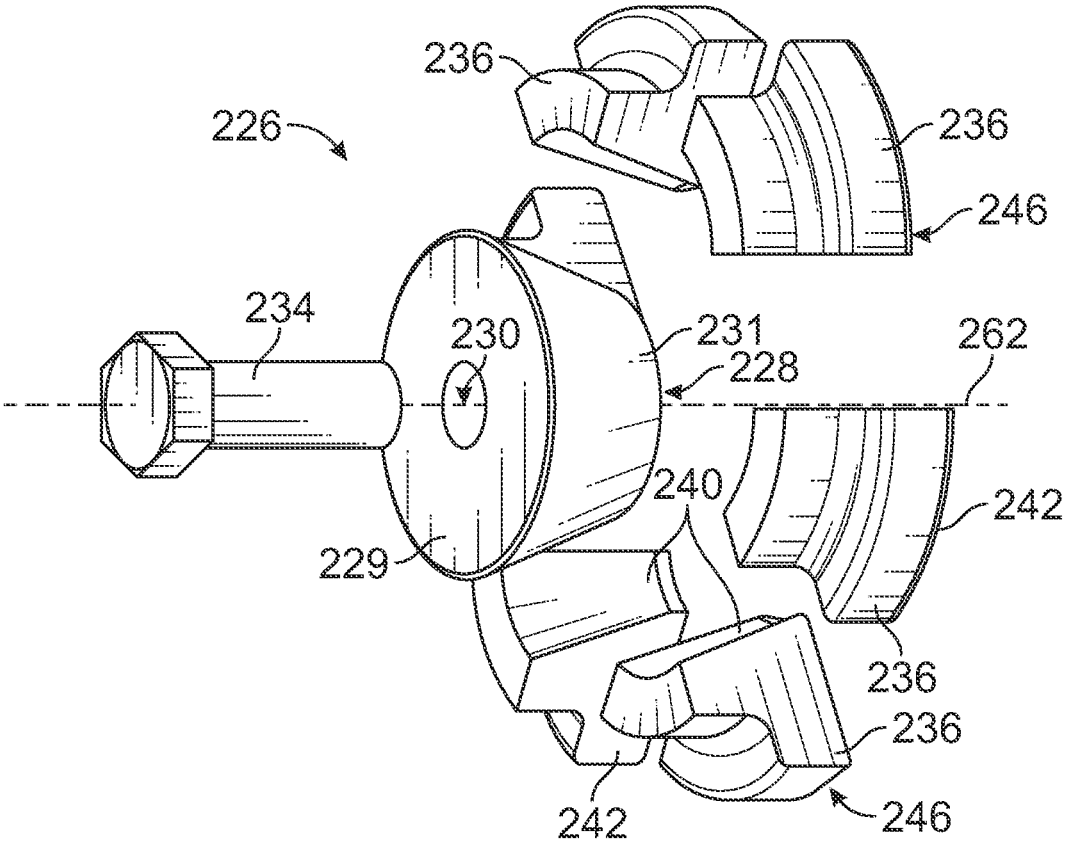
FIG. 15 is an exploded perspective view of the retainer assembly of FIG. 14.
Figure 16:
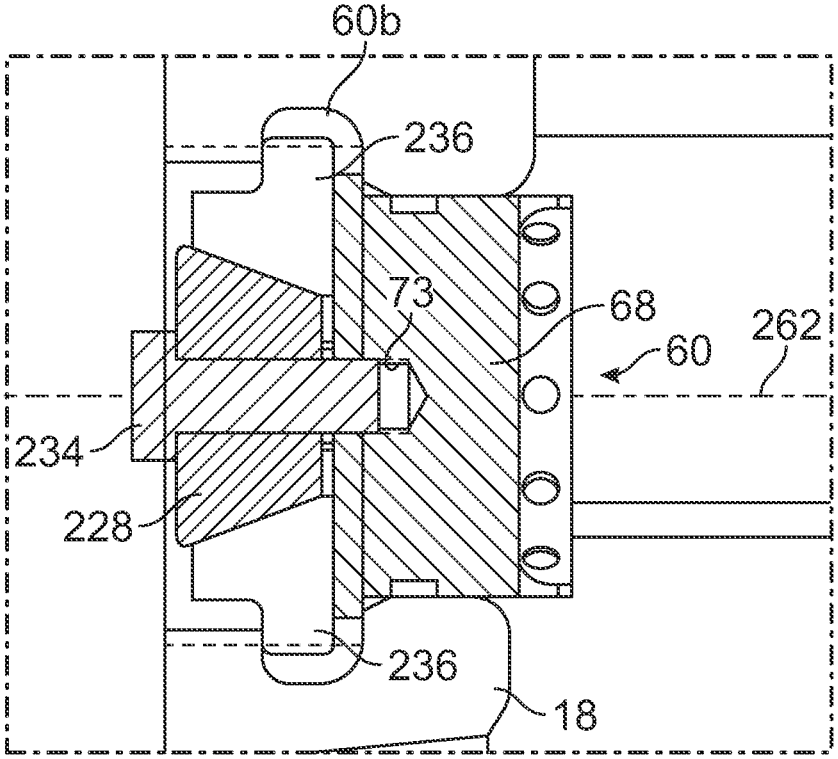
FIG. 16 is a cross section side view of the retainer assembly of FIGS. 14-15 installed.

FIGS. 14-16 show further aspects of a retainer assembly 226 according to the disclosure. The retainer assembly 226 includes a retainer body 228, which has a frusto-conical body shape. Accordingly, the retainer body 228 has a first end 229 with a first diameter and a second end 231 with a second diameter, the second diameter being less than the first diameter. The retainer body 228 includes a cylindrical hole 230 formed through the retainer body and aligned with and centered on an axis 262 of the body. A fastener 234 is configured to reside in the hole 230 with a portion of the fastener extending from the second end. In embodiments, the fastener 234 functions as a locking mechanism.

A plurality of tongues 236 are positionable about the retainer body 228. In embodiments, there may be six tongues 236, however other numbers of tongues are contemplated. Each of the tongues 236 have a sloped inner face 240 that has an angle deviating from the axis 262 that complements the shape of the retainer body 228 such that the sloped inner face 240 slidably contacts the spreader along its length. The overall shape of each of the tongues 236 is L-shaped with a radially outwardly extending flange 242. A flange 242 is located at or near the inner end 246 of the tongue 236 such that when a plurality of tongues are assembled to the retainer body 228, the flanges are positioned adjacent the second end 231. The size of the tongues 236 and flanges 242 is such that when the tongues are assembled to the retainer body 228 in an initial condition with the retainer body less than fully inserted into the tongues, the retainer assembly 226 can be inserted into the bore 60.

When the retainer body 228 is moved into the plurality of tongues 236, to assume a position essentially co-planar therewith, the tongues are urged outwardly where the flanges 242, are moved away from axis 262. The flanges 242, which are shaped to fit within and engage the retainer channel 60*b* (see FIG. 16), are moved within the retainer channel, are held in the expanded condition shown in FIG. 16, and prevent the retainer assembly 226 from backing out of the bore 60. Independently, the retainer assembly 226 may be held together by a circumferential or garter spring (not shown). Referring to FIG. 16, previous to installing the retainer assembly 226 to the fluid block 18, a plug 68 is positioned in the bore 60. The plug 68 may have a threaded opening 73 formed in the plug along axis 262 which receives the fastener 234 to secure the retainer assembly 226 in position.

Installation of the plug 68 and retainer assembly 226 may proceed by inserting the plug into the bore 60. The tongues 236 and retainer body 228 are positioned in the bore 60 with the flanges 242 positioned at and adjacent the retainer channel 60*b*. The fastener 234 is inserted into the hole 230 at the first end 229 of the retainer body 228 and threaded into the opening 73 of the plug 68. Rotating the fastener 234 causes the retainer body 228 to be drawn into the bore 60 toward the plug 68 and the complementary wedge shape between the retainer body and the plurality of tongues 236 spreads the tongues radially apart causing the tongue flanges 242 to be moved radially into the retainer channel 60*b*. The retainer assembly 226 is also caused to be moved into contact with the plug 68 which secures the plug into position in the bore 60.

Figure 17:
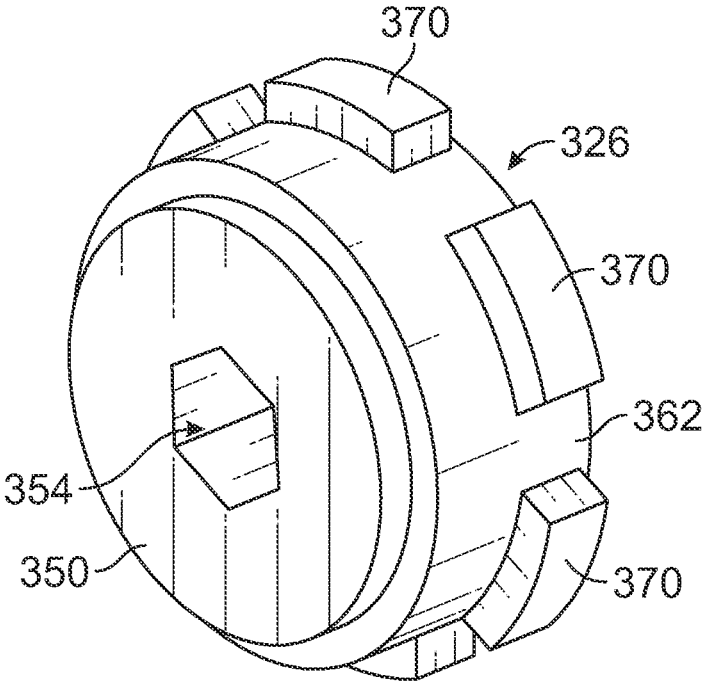
FIG. 17 is a perspective view of a retainer assembly according to an alternative embodiment.
Figure 18:
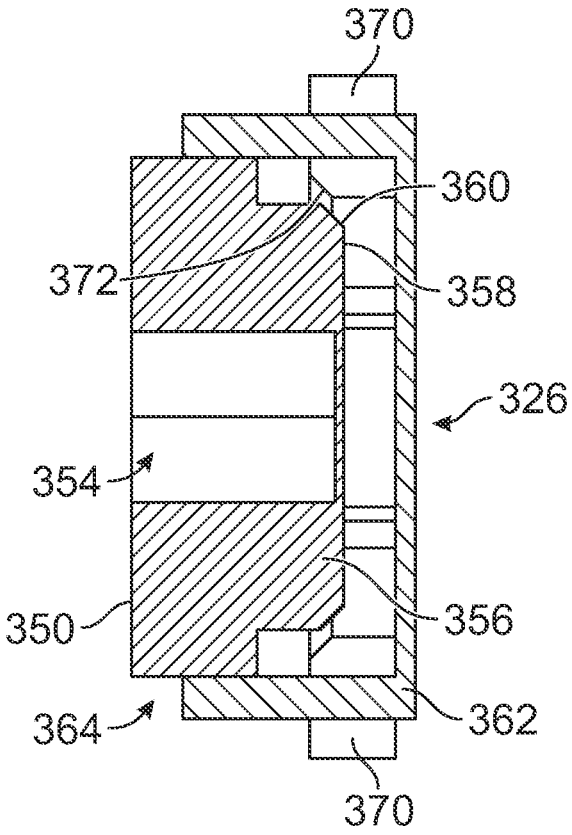
FIG. 18 is a cross section side view of the retainer assembly of FIG. 17.
Figure 19:
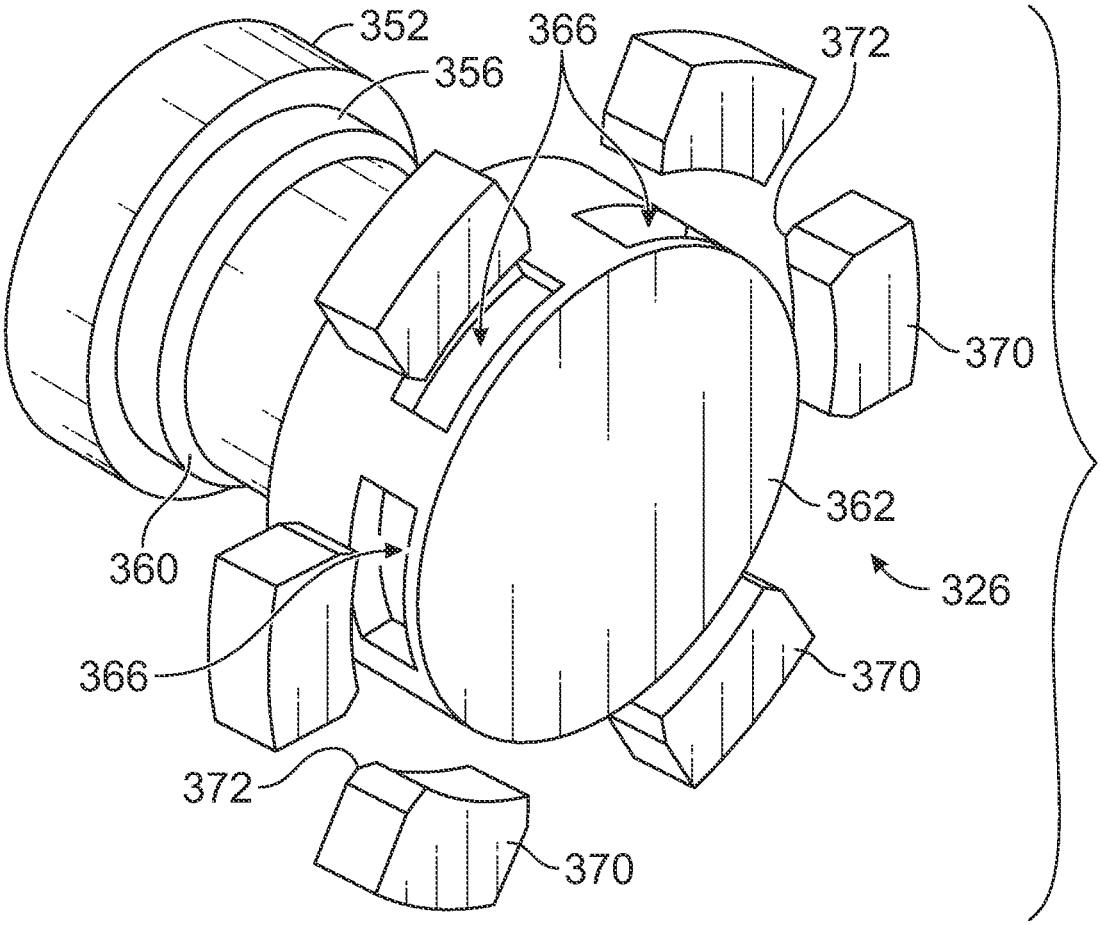
FIG. 19 is an exploded perspective view of the retainer assembly of FIG. 17.

FIGS. 17-19 show yet another aspect of a retainer assembly 326 according to the disclosure. The retainer assembly 326 includes a retainer body 350. The retainer body 350 includes a first cylindrical portion 352 that includes a tool receptacle 354. The tool receptacle 354 may be shaped to receive a hex wrench (not shown) for example. The retainer body 350 includes a second cylindrical portion 356 extending from the first cylindrical portion 352. The second cylindrical portion 356 has a reduced radial diameter relative to the first cylindrical position 352. The distal end 358 of the second cylindrical portion 356 has an annular bevel 360. The annular bevel 360 may be formed at an angle of about 45 degrees, for example.

The retainer assembly 326 includes a housing 362 which has an open end 364, wherein the housing is shaped and sized to threadably receive and engage the retainer body 350. Rotation of the retainer body 350 in the housing 362 causes the wedge body to be advanced into the housing.

The housing 362 includes a plurality of windows 366 spaced about a cylindrical wall 368 of the housing. A tongue 370 is movably disposed in each one of the plurality of windows 366 such that the tongues can move radially inward and outward of the windows. Each tongue 370 is a generally rectangular piece with a wedge face 372 that is positioned to engage in a cooperative manner to the annular bevel 360 of the retainer body 350.

Installation of the retainer assembly 326 proceeds in a manner similar to that shown in FIG. 16, for example. A plug 68 is installed in a counterbore 60 of a fluid end 18. The retainer assembly 326 is positioned in the bore 60 outside the plug. The tongues 370 are positioned radially adjacent the retainer channel **60*b* with a single one of the tongues inserted into a respective window 366. When the retainer body 350 is rotated within the housing 362 the advancement of the retainer body in the housing brings the annular bevel 360 into engagement with the wedge faces 372 of the tongues 370. As a result, the tongues 370 are moved radially outwardly into the retainer channel 60*b* thus locking the retainer assembly in the bore 60 and securing the plug 68 in sealing engagement with the fluid block 18. Removal of the retainer assembly 326 proceeds in a reverse manner, where the retainer body 350 is rotated, for example counterclockwise, which permits withdrawal of the tongues 370 from the retainer channel 60*b* and removal of the retainer assembly and the plug 68** if desired.

INDUSTRIAL APPLICABILITY

The industrial applicability of the system described herein will be readily appreciated from the forgoing discussion. The foregoing discussion is applicable to fluid ends of reciprocating pump assemblies, in particular, for pumping fluid media in fracturing operations and similar applications.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Unless explicitly excluded, the use of the singular to describe a component, structure, or operation does not exclude the use of plural such components, structures, or operations or their equivalents. The use of the terms "a" and "an" and "the" and "at least one" or the term "one or more," and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B" or one or more of A and B") is to be construed to mean one item selected from the listed items (A or B) or any combination of two or more of the listed items (A and B; A, A and B; A, B and B), unless otherwise indicated herein or clearly contradicted by context. Similarly, as used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A retainer assembly and a plug for a fluid end of a pump system, comprising:

a retainer body;

a plurality of tongues movably arranged about and in contact with the retainer body, each of the plurality of tongues being movable between a pre-installed configuration and an installed configuration depending on a position of the retainer body relative to the plurality of tongues, a first tongue, of the plurality of tongues, including an engaging flange and a first passage, a second tongue, of the plurality of tongues, including a second passage, the plurality of tongues being movable between the pre-installed configuration defining a first diameter configured to permit the retainer assembly to be inserted into a bore of the fluid end and the installed configuration defining a second diameter, and the second diameter being larger than the first diameter;

a rod disposed in the first passage and the second passage to interconnect the first tongue to the second tongue; and the plug, the plug being shaped and sized to sealingly fit to the bore of the fluid end inboard of the retainer assembly.

2. The retainer assembly and the plug of claim 1, further comprising:

a locking mechanism configured to secure the retainer assembly to the plug, and wherein, when the retainer assembly is secured to the plug, the position of the retainer body is configured to be maintained relative to the plurality of tongues.

3. The retainer assembly and the plug of claim 1, wherein the retainer body is a cone with a flaring rim.

4. The retainer assembly and the plug of claim 1,
wherein the plurality of tongues are configured to engage a retaining channel formed in the fluid end, and
wherein, when in the installed configuration, the engaging flange is configured to be positioned in the retaining channel to retain the retainer assembly to the fluid end.

5. The retainer assembly and the plug of claim 1,
wherein the first tongue further includes:
a top edge that extends radially inwardly, and
a bottom edge that extends radially outwardly relative to the top edge, and
wherein the bottom edge includes the engaging flange.

6. The retainer assembly and the plug of claim 1,
wherein, in the pre-installed configuration, a rim of the retainer body is configured to be positioned adjacent a top edge of the first tongue, and
wherein, when in the installed configuration, the rim is configured to be positioned radially adjacent the engaging flange.

7. The retainer assembly and the plug of claim 1, wherein the rod is configured to permit the first tongue to pivot.

8. The retainer assembly and the plug of claim 1, further comprising:
a locking mechanism that includes a body and a handle fixed to the body,
wherein the body is attached to and extends through the retainer body and is configured to be biased in an outboard direction when installed in the fluid end.

9. The retainer assembly and the plug of claim 1, further comprising:
a locking mechanism that includes a body,
wherein the body is configured to be attached to the plug and secure the retainer assembly to the plug when in the installed configuration, and
wherein a rim, of the retainer body, is configured to be maintained against the engaging flange of the first tongue when in the installed configuration.

10. The retainer assembly and the plug of claim 1,
wherein the plug includes a slot and a passageway, and
wherein a locking mechanism, of the retainer assembly, includes a pin that is sized and shaped to be inserted into the slot and rotated into the passageway to lock the locking mechanism and the retainer body to the plug in the installed configuration.

11. A pump system, comprising:
a retainer body;
a plurality of tongues arranged relative to the retainer body,
the plurality of tongues including:
a first tongue including an engaging flange and a passage, and
a second tongue,
the plurality of tongues being movable between a first configuration and a second configuration,
the first configuration defining a first diameter,
the second configuration defining a second diameter, and
the second diameter being larger than the first diameter;
a rod disposed in the passage to interconnect the first tongue to the second tongue; and
a plug,
wherein one or more of:
the retainer body is a cone with a rim, or
the rod includes a bend.

12. The pump system of claim 11, further comprising:
a locking mechanism configured to secure the retainer body to the plug.

13. The pump system of claim 11, wherein the retainer body is the cone with the rim.

14. The pump system of claim 11,
wherein the first tongue further includes:
a top edge that extends radially inwardly, and
a bottom edge that extends radially outwardly relative to the top edge, and
wherein the bottom edge includes the engaging flange.

15. The pump system of claim 11,
wherein the passage is a first passage,
wherein the second tongue includes a second passage, and
wherein the rod is further disposed in the second passage.

16. The pump system of claim 15,
wherein the rod is a first rod,
wherein the pump system further includes a second rod,
wherein the plurality of tongues further include a third tongue,
wherein the third tongue includes a third passage, and
wherein the second rod is disposed in the second passage and the third passage.

17. The pump system of claim 11, wherein the rod is configured to permit the first tongue to pivot.

18. The pump system of claim 11, wherein the rod includes the bend.

19. A system for pumping, comprising:
a first tongue configured to be arranged relative to a retainer body of a retainer assembly that is secured to a plug,
the first tongue including:
an engaging flange, and
a passage that receives a first rod at a first end of the passage and a second rod at a second end of the passage,
the first tongue being movable between a first configuration and a second configuration,
the first configuration defining a first diameter,
the second configuration defining a second diameter, and
the second diameter being larger than the first diameter.

20. The system of claim 19, wherein the first rod includes a bend.

* * * * *